US010438570B2

(12) United States Patent
Nakao et al.

(10) Patent No.: US 10,438,570 B2
(45) Date of Patent: Oct. 8, 2019

(54) DISPLAY APPARATUS

(71) Applicant: Japan Display Inc., Tokyo (JP)

(72) Inventors: Takayuki Nakao, Tokyo (JP); Takehiro Shima, Tokyo (JP)

(73) Assignee: Japan Display Inc., Tokyo (JP)

( * ) Notice: Subject to any disclaimer, the term of this patent is extended or adjusted under 35 U.S.C. 154(b) by 109 days.

(21) Appl. No.: 15/699,634

(22) Filed: Sep. 8, 2017

(65) Prior Publication Data

US 2018/0075823 A1 Mar. 15, 2018

(30) Foreign Application Priority Data

Sep. 12, 2016 (JP) ..... 2016-177504

(51) Int. Cl.

*G09G 3/36* (2006.01)
*G09G 5/395* (2006.01)
*G09G 5/393* (2006.01)

(52) U.S. Cl.

CPC ..... *G09G 5/395* (2013.01); *G09G 3/3677* (2013.01); *G09G 5/393* (2013.01); *G09G 3/3655* (2013.01); *G09G 2300/0857* (2013.01); *G09G 2310/08* (2013.01); *G09G 2330/026* (2013.01)

(58) Field of Classification Search

USPC ..... 345/84, 98, 168, 204, 212, 547, 506, 96, 345/549, 559, 690, 215; 315/111.21

See application file for complete search history.

(56) References Cited

U.S. PATENT DOCUMENTS 6,462,743 B1 * 10/2002 Battle ..... G06F 15/8053 345/506
2005/0017941 A1 * 1/2005 Simon ..... G09G 3/3611 345/98
2008/0024420 A1 * 1/2008 Nakai ..... G09G 3/3614 345/98
2008/0238855 A1 * 10/2008 Teranishi ..... G09G 3/2011 345/98
2009/0179878 A1 * 7/2009 Nakamura ..... G09G 5/399 345/204
2011/0260956 A1 * 10/2011 Govil ..... G09G 3/3466 345/84
2012/0069060 A1 * 3/2012 Handschy ..... G09G 3/3629 345/690
2012/0075320 A1 * 3/2012 Handschy ..... G09G 3/3629 345/559

(Continued)

*Primary Examiner* — Thuy N Pardo
(74) *Attorney, Agent, or Firm* — K&L Gates LLP

(57) ABSTRACT

According to an aspect, a display apparatus includes: a plurality of pixels each of which includes a memory for storing a signal; a plurality of image signal lines each of which is configured to supply the signal; a plurality of switches each of which is included in a corresponding one of the pixels and couples a corresponding one of the image signal lines to the memory of the corresponding one of the pixels; a plurality of gate signal lines; a plurality of logic circuits coupled in series, the logic circuit at a most upstream stage being configured to receive a control signal, and each of the logic circuits being configured to output an output signal; and a plurality of control circuits each of which is configured to output a gate signal to a corresponding one of the gate signal lines based on the control signal or the output signal.

13 Claims, 11 Drawing Sheets

(56) References Cited

U.S. PATENT DOCUMENTS

| | | | | |
|---|---|---|---|---|
| 2012/0188166 | A1* | 7/2012 | Nurmi | G09G 3/3648 345/168 |
| 2012/0313924 | A1* | 12/2012 | Kitagawa | G09G 5/003 345/212 |
| 2015/0326000 | A1* | 11/2015 | Kanzaki | H02H 7/1257 361/101 |
| 2015/0340015 | A1* | 11/2015 | Yoshida | G09G 3/20 345/547 |
| 2018/0301323 | A1* | 10/2018 | Grede | H01J 37/32944 315/111.21 |

* cited by examiner

FIG. 4

T1

| FIRST INPUT SIGNAL (xINIT) | SECOND INPUT SIGNAL (SEL) | OUTPUT SIGNAL (Gate) |
|---|---|---|
| 0 | 0 | 1 |
| 0 | 1 | 1 |
| 1 | 0 | 0 |
| 1 | 1 | 1 |

T2

| FIRST INPUT SIGNAL (OUTPUT SIGNAL OF DEL OF UPSTREAM STAGE) | SECOND INPUT SIGNAL (SEL) | OUTPUT SIGNAL (Gate) |
|---|---|---|
| 0 | 0 | 0 |
| 0 | 1 | 1 |
| 1 | 0 | 1 |
| 1 | 1 | 1 |

DISPLAY APPARATUS

CROSS-REFERENCE TO RELATED APPLICATIONS

This application claims priority from Japanese Application No. 2016-177504, filed on Sep. 12, 2016, the contents of which are incorporated by reference herein in its entirety.

BACKGROUND

1. Technical Field

The present invention relates to a display apparatus.

2. Description of the Related Art

A display apparatus that displays an image includes a plurality of pixels. Japanese Patent Application Laid-open Publication No. 2008-256762, discloses a memory-in-pixel (MIP) type image display apparatus in which each of the pixels includes a memory.

In such a MIP type display apparatus, there may be cases in which it is desired to initialize the memories of the pixels. Examples of such cases include the time of power-on of the display apparatus, and the time of return from sleep state (hereinafter referred to as the time of start-up).

It is indeterminable whether the value held in the memory of the MIP type display apparatus at the time of start-up will be a low level or a high level. Consequently, unless the memory of each pixel of the MIP type display apparatus is initialized at the time of start-up, the display of each pixel may be different from an input signal. In order to resolve such a problem, in the display apparatus of the MIP technology, it is desired to initialize the memories of a plurality of pixels at the time of start-up.

In this case, when attempting to write a low level or a high level value into the memories of the pixels simultaneously, a load of an output circuit that outputs signals to the respective memories is increased. Thus, when the number of pixels is increased, the value may not be stably written into the memories. That is, some of the memories of the pixels may not be initialized.

For example, when, as with the way in normal image display, attempting to write a low level or a high level value into memories of the pixels row by row in synchronization with a clock signal, one frame time is required. In a case where a frame frequency is 60 Hz, one frame time is 16.67 milliseconds. That is, it takes 16.67 milliseconds to write a low level or a high level value into the memories of the pixels row by row.

For the foregoing reasons, there is a need for a display apparatus capable of stably initializing the memories of a plurality of pixels in a short time.

SUMMARY

According to an aspect, a display apparatus includes: a plurality of pixels each of which includes a memory for storing a signal corresponding to image information; a plurality of image signal lines each of which is configured to supply the signal corresponding to the image information; a plurality of switches each of which is included in a corresponding one of the pixels and couples a corresponding one of the image signal lines to the memory of the corresponding one of the pixels; a plurality of gate signal lines, a control input side of each of the switches being coupled to a corresponding one of the gate signal lines; a plurality of logic circuits that are coupled in series, the logic circuit at a most upstream stage of the logic circuits being configured to receive a control signal, and each of the logic circuits being configured to output an output signal; and a plurality of control circuits each of which is configured to receive the control signal and the output signal and output a gate signal to a corresponding one of the gate signal lines based on the control signal or the output signal.

BRIEF DESCRIPTION OF THE DRAWINGS

FIG. 4 is a diagram illustrating a truth table of an initialization control circuit according to the first comparative example;

DETAILED DESCRIPTION

The following describes exemplary forms of implementing the present invention with reference to the accompanying drawings. Note that the disclosure is a mere example in any case, and appropriate modifications retaining the spirit of the invention that those skilled in the art can easily perceive are rightly included within the scope of the invention. Although the drawings may be schematically illustrated in terms of width, thickness, shape, and others of various portions as compared with the actual forms in order to further clarify the explanation, the drawings are examples anyway and are not intended to limit the interpretation of the invention. In the description and each of the drawings, the elements the same as those previously described concerning the previously described drawings are given the identical reference signs and their detailed explanations may be omitted as appropriate.

In this disclosure, when an element is described as being "on" another element, the element can be directly on the other element, or there can be one or more elements between the element and the other element.

EMBODIMENT

Outline of Configuration

Figure 1:
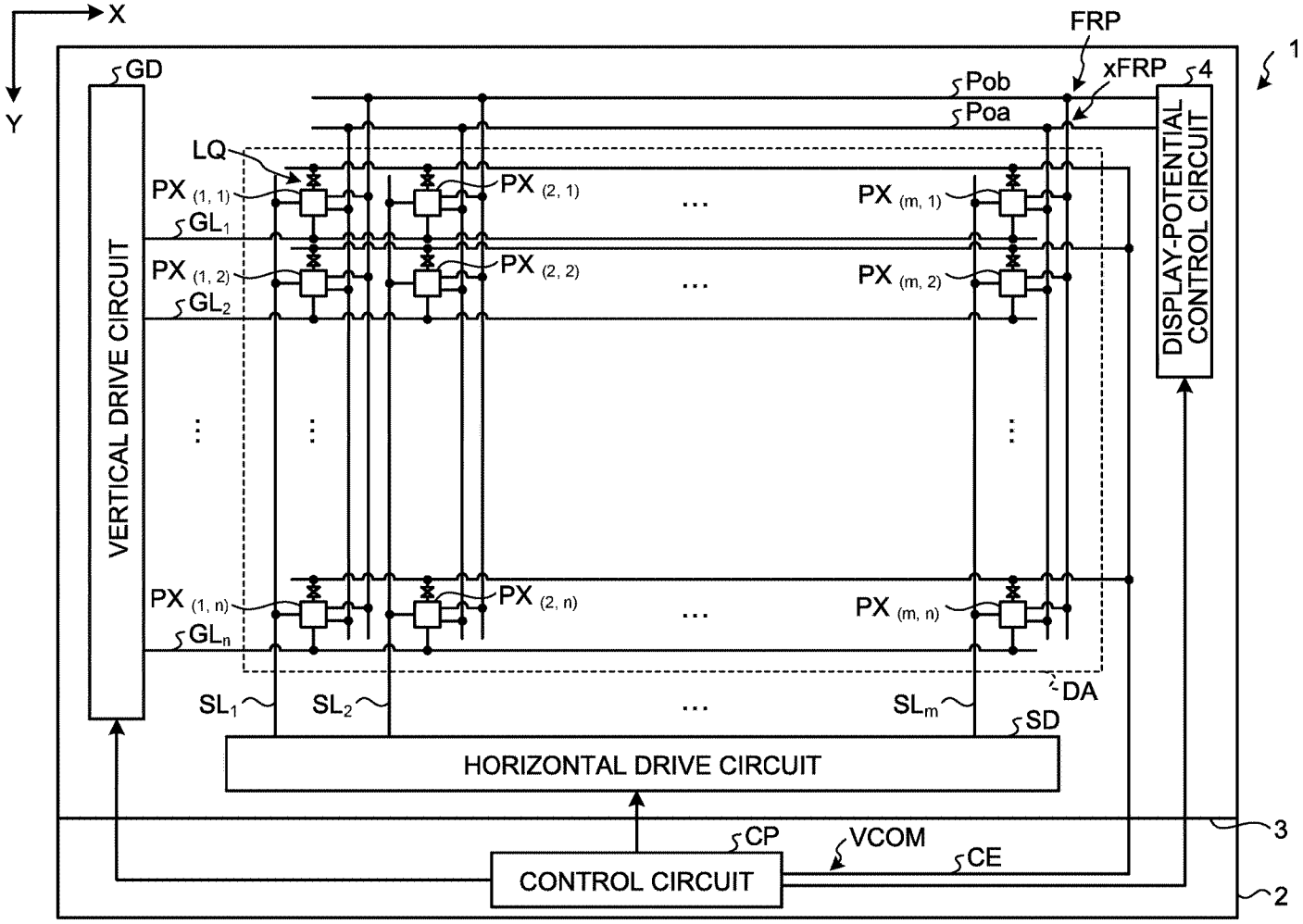
FIG. 1 is a block diagram illustrating a configuration of a display apparatus according to an embodiment.

FIG. 1 is a block diagram illustrating a configuration of a display apparatus according to an embodiment of the present invention.

A display apparatus 1 is an active-matrix display apparatus. Examples of the display apparatus 1 include a reflective liquid crystal display apparatus, a transflective liquid crystal display apparatus, and a transmissive liquid crystal display apparatus.

The display apparatus 1 includes a first substrate 2, a second substrate 3 that is arranged opposite to the first substrate 2, and a liquid crystal layer LQ that is arranged between the first substrate 2 and the second substrate 3.

A display area DA is an area to display an image, and corresponds to an area in which the liquid crystal layer LQ is arranged between the first substrate 2 and the second substrate 3. In the embodiment, the display area DA has a quadrilateral shape. However, the embodiment is not limited thereto. The display area DA may have a circular shape, an elliptical shape, a shape obtained by rounding the corners of a quadrilateral shape, and other shapes.

A plurality of pixels $PX_{(1,1)}, \ldots PX_{(m,n)}$ (m and n are integers) are arranged in the display area DA. The pixels $PX_{(1,1)}, \ldots PX_{(m,n)}$ are arranged in a matrix of m columns along an X direction and of n rows along a Y direction intersecting with the X direction. Thus, in the embodiment, the pixels PX are arranged in a matrix. However, the arrangement of the pixels PX is not limited thereto. The pixels PX may be arranged so that upper rows and lower rows are offset from each other.

A plurality of gate signal lines (gate lines) $GL_1, \ldots GL_n$ and a plurality of image signal lines (source lines) $SL_1, \ldots SL_m$ are arranged in the display area DA. The gate lines $GL_1, \ldots GL_n$ extend along the X direction, and the source lines $SL_1, \ldots SL_m$ extend along the Y direction.

Each of the gate signal lines $GL_1, \ldots GL_n$ extends to the outside (the left-hand side in FIG. 1, an opposite side to the X direction) of the display area DA and is coupled to a vertical drive circuit (a gate-signal line drive circuit, a gate driver) GD. The vertical drive circuit GD is arranged in a frame area outside the display area DA. Each of the gate signal lines $GL_1, \ldots GL_n$ is coupled to m pixels PX belonging to a single row.

Each of the image signal lines $SL_1, \ldots SL_m$ extends to the outside (a lower side in FIG. 1, the Y direction side) of the display area DA and is coupled to a horizontal drive circuit (an image-signal line drive circuit, a source driver) SD. The horizontal drive circuit is arranged in the frame area outside the display area DA. Each of the image signal lines $SL_1, \ldots SL_m$ is coupled to n pixels PX belonging to a single column.

The vertical drive circuit GD and the horizontal drive circuit SD are coupled to a control circuit (may be referred to as a drive IC chip or a liquid crystal driver) CP. At least a part of the control circuit CP is arranged on the first substrate 2, for example. In the example illustrated in FIG. 1, the control circuit CP is mounted on the first substrate 2 in the frame area outside the display area DA. Alternatively, the control circuit CP may be arranged on a flexible substrate that is coupled to the frame area.

The horizontal drive circuit SD receives a pixel signal from the control circuit CP and supplies the pixel signal to the corresponding pixels PX via the image signal line SL.

The control circuit CP includes a clock and timing-pulse generation circuit (may be referred to as a controller or a sequencer) in order to control the vertical drive circuit GD and the horizontal drive circuit SD. The clock and timing-pulse generation circuit generates timing pulses necessary to synchronously operate the entire display apparatus 1.

A common electrode CE is formed of transparent material. The common electrode CE is shared among some or all of the pixels PX, for example. The common electrode CE is drawn out to the frame area outside the display area DA and is coupled to the control circuit CP. The control circuit CP supplies, to the common electrode CE, a constant common voltage (may be referred to as a common signal) VCOM. An electric field for driving the liquid crystal layer LQ is generated between a pixel electrode PE which will be described later and the common electrode CE.

A display-potential control circuit 4 (a power supply) is arranged in the frame area outside the display area DA. The display-potential control circuit 4 supplies a first display signal (a displaying signal) xFRP to the pixels PX via a first display signal line Poa and supplies a second display signal (a non-displaying signal) FRP to the pixels PX via a second display signal line Pob. The first display signal xFRP and the second display signal FRP are AC signals with opposite phases.

The voltage of the first display signal xFRP is an example of "a first display voltage" of the present invention. The voltage of the second display signal FRP is an example of "a second display voltage" of the present invention.

Color filters are provided for the pixels PX according to a certain rule. The color filters face the pixel electrodes PE so as to sandwich the liquid crystal layer LQ, and are arranged on the second substrate 3.

Figure 2:
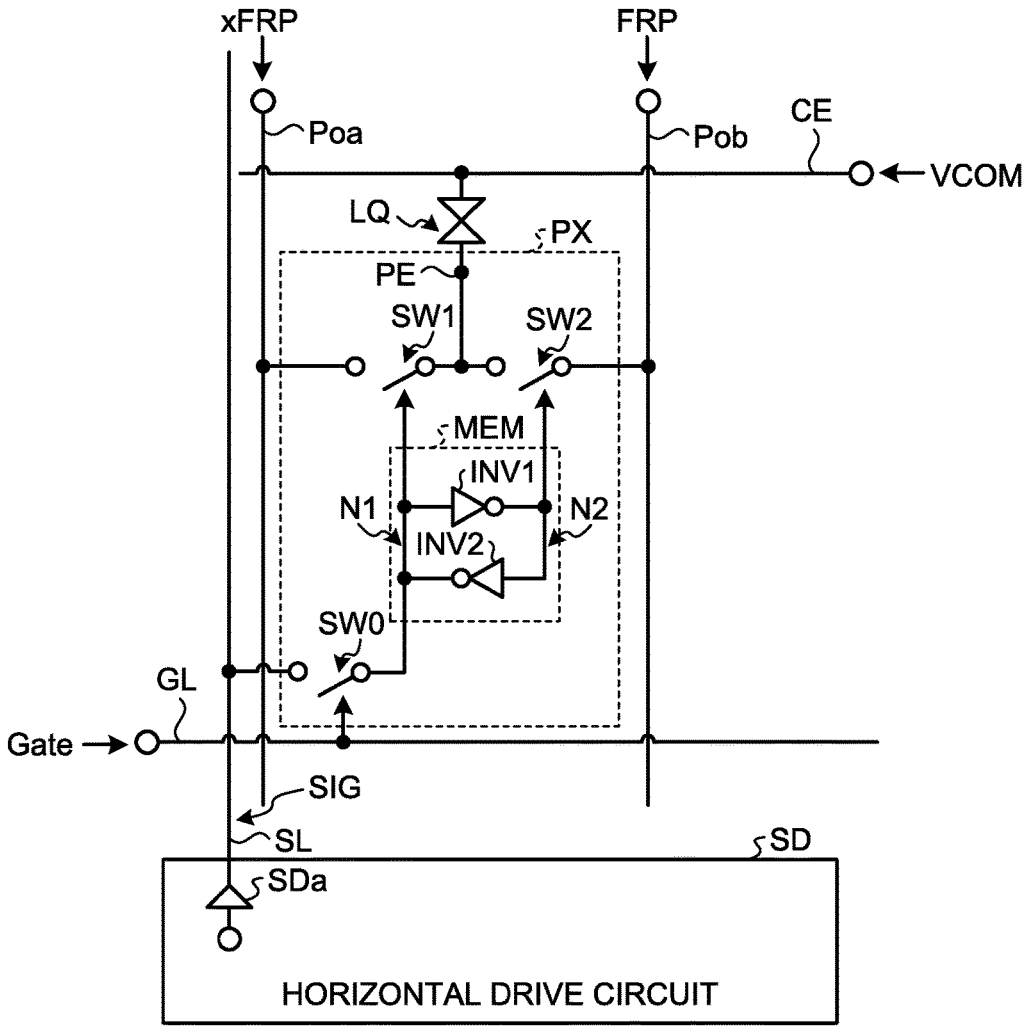
FIG. 2 is a diagram illustrating a configuration of a pixel of the display apparatus according to the embodiment.

FIG. 2 is a diagram illustrating a configuration of a pixel of the display apparatus 1 according to the embodiment of the present invention.

The pixel PX has a switch SW0. An input terminal of the switch SW0 is coupled to the image signal line SL, and an output terminal of the switch SW0 is coupled to a node N1 of a memory MEM. The image signal line SL is supplied with a source signal SIG from an output circuit SDa in the horizontal drive circuit SD.

A control terminal of the switch SW0 is coupled to the gate signal line GL and is supplied with a gate signal Gate. The gate signal Gate has a positive logic (high-active). When the gate signal Gate is at a high level, the switch SW0 assumes an on-state, and the source signal SIG is supplied to the memory MEM.

The memory MEM has a static random access memory (SRAM) cell structure that includes an inverter circuit INV1 and an inverter circuit INV2. The inverter circuit INV2 is coupled parallel to the inverter circuit INV1 and in the opposite direction of the inverter circuit INV1. An input terminal of the inverter circuit INV1 and an output terminal of the inverter circuit INV2 constitute the node N1, and an output terminal of the inverter circuit INV1 and an input terminal of the inverter circuit INV2 constitute a node N2.

The node N1 is coupled to the output terminal of the switch SW0 and a control terminal of a switch SW1. The node N2 is coupled to a control terminal of a switch SW2.

An input terminal of the switch SW1 is coupled to the first display signal line Poa, and an output terminal of the switch SW1 is coupled to the pixel electrode PE. When the node N1 is at a high level, the switch SW1 assumes an on-state, and the first display signal xFRP is supplied to the pixel electrode PE.

An input terminal of the switch SW2 is coupled to the second display signal line Pob, and an output terminal of the switch SW2 is coupled to the pixel electrode PE. When the node N2 is at a high level, the switch SW2 assumes an on-state, and the second display signal FRP is supplied to the pixel electrode PE.

The common electrode CE facing the pixel electrode PE is supplied with the common signal VCOM from the control circuit CP. The common signal VCOM is an AC signal of the same phase as that of the second display signal FRP. Accordingly, when the switch SW2 is in the on-state and the second display signal FRP is supplied to the pixel electrode PE, no voltage is applied to the liquid crystal layer LQ and the pixel PX assumes a non-display state. By contrast, when the switch SW1 is in the on-state and the first display signal xFRP is supplied to the pixel electrode PE, a voltage is applied to the liquid crystal layer LQ and the pixel PX assumes a display state.

First Comparative Example

Figure 3:
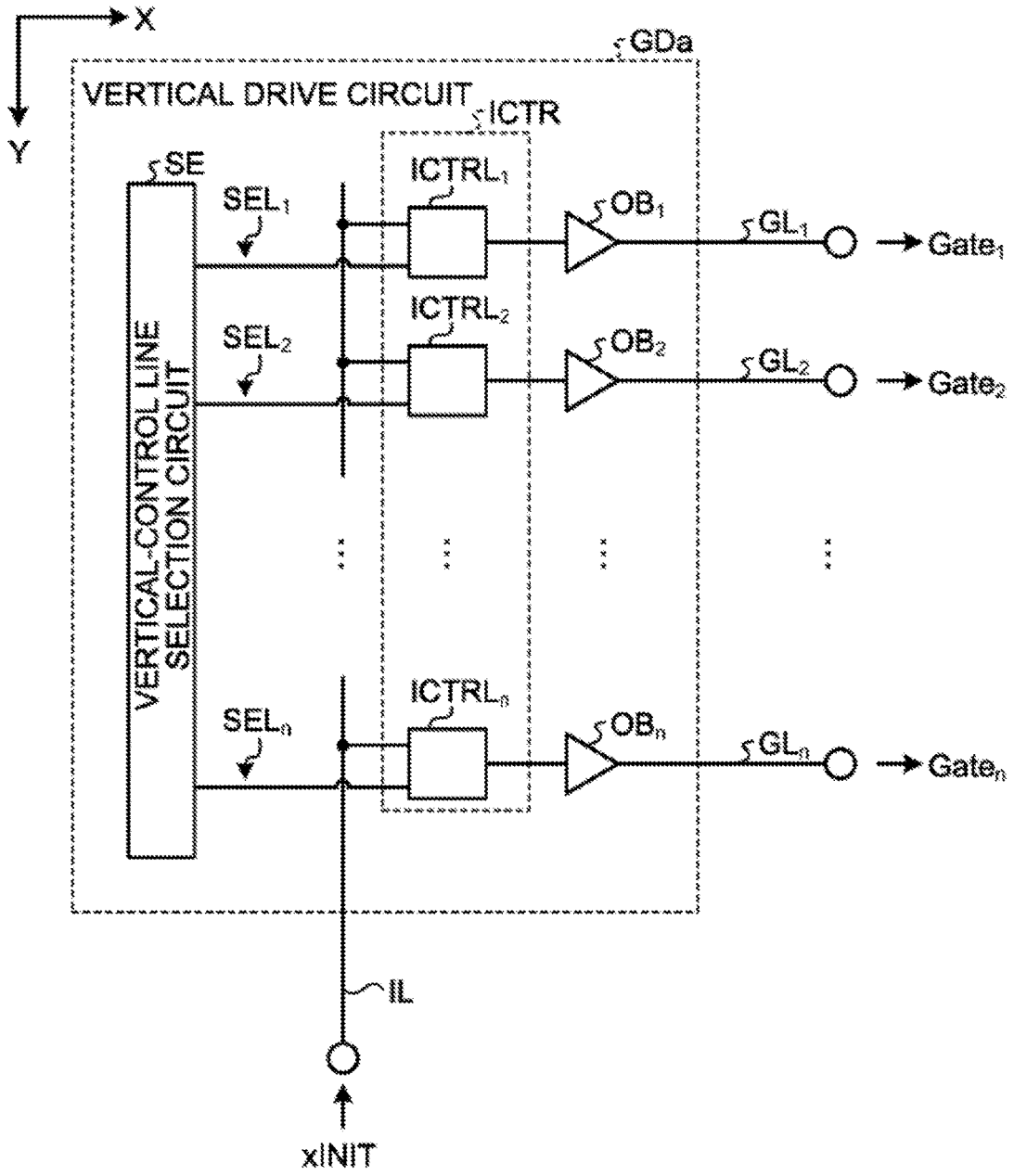
FIG. 3 is a diagram illustrating a configuration of a vertical drive circuit according to a first comparative example.

FIG. 3 is a diagram illustrating a configuration of a vertical drive circuit according to a first comparative example.

A vertical drive circuit GDa has a vertical-control line selection circuit SE. The vertical-control line selection circuit SE sequentially outputs selection signals $SEL_1$, $SEL_2$, . . . $SEL_n$ for sequentially selecting the pixels $PX_{(1,1)}$, . . . $PX_{(m,n)}$ row by row. The selection signal SEL has a positive logic (high-active).

The vertical-control line selection circuit SE may be a scanner circuit that sequentially outputs the selection signals $SEL_1$, $SEL_2$, . . . $SEL_n$, based on a scan start signal and a clock pulse signal supplied from the control circuit CP. The vertical-control line selection circuit SE may be a decoder circuit that decodes an encoded control signal supplied from the control circuit CP and outputs the selection signals $SEL_1$, $SEL_2$, . . . $SEL_n$ specified by the control signal.

The vertical drive circuit GDa has an initialization circuit ICTR. The initialization circuit ICTR includes a plurality of initialization control circuits $ICTRL_1$, $ICTRL_2$, . . . $ICTRL_n$. Each of the initialization control circuits $ICTRL_1$, $ICTRL_2$, . . . $ICTRL_n$ is a logic circuit of two inputs and one output.

First input terminals of the initialization control circuits $ICTRL_1$, $ICTRL_2$, . . . $ICTRL_n$ are coupled to an initialization signal line IL. The initialization signal line IL is supplied with an initialization signal xINIT from the control circuit CP. The initialization signal xINIT has a negative logic (low-active).

Second input terminals of the initialization control circuits $ICTRL_1$, $ICTRL_2$, . . . $ICTRL_n$ are supplied with the selection signals $SEL_1$, $SEL_2$, . . . $SEL_n$, respectively.

Output terminals of the initialization control circuits $ICTRL_1$, $ICTRL_2$, . . . $ICTRL_n$ are respectively coupled to output circuits $OB_1$, $OB_2$, . . . $OB_n$. Each of the output circuits $OB_1$, $OB_2$, . . . $OB_n$ is exemplified by a buffer circuit. The output circuits $OB_1$, $OB_2$, . . . $OB_n$ respectively output the gate signals $Gate_1$, $Gate_2$, . . . $Gate_n$ to the gate signal lines $GL_1$, $GL_2$, . . . $GL_n$.

FIG. 4 is a diagram illustrating a truth table of the initialization control circuit according to the first comparative example.

A first input signal (an initialization signal xINIT) supplied to the first input terminal of the initialization control circuit ICTRL has a negative logic (low-active). A second input signal (a selection signal SEL) supplied to the second input terminal of the initialization control circuit ICTRL has a positive logic (high-active). The output signal (the gate signal Gate) from the initialization control circuit ICTRL has a positive logic (high-active).

As indicated in the first row and the second row of a truth table T1, when the initialization signal xINIT is active, that is, when the initialization signal xINIT is at a low level, the initialization control circuit ICTRL causes the gate signal Gate to be active, that is, outputs the gate signal Gate of a high level regardless of the value of the selection signal SEL.

When the initialization signal xINIT is non-active, that is, when the initialization signal xINIT is at a high level, the initialization control circuit ICTRL causes the gate signal Gate to be active or non-active depending on the value of the selection signal SEL. That is, as indicated in the third row of the truth table T1, when the initialization signal xINIT is at a high level and the selection signal SEL is at a low level, the initialization control circuit ICTRL causes the gate signal Gate to be non-active, that is, outputs the gate signal Gate of a low level. As indicated in the fourth row of the truth table T1, when the initialization signal xINIT is at a high level and the selection signal SEL is at a high level, the initialization control circuit ICTRL causes the gate signal Gate to be active, that is, outputs the gate signal Gate of a high level.

Figure 5:
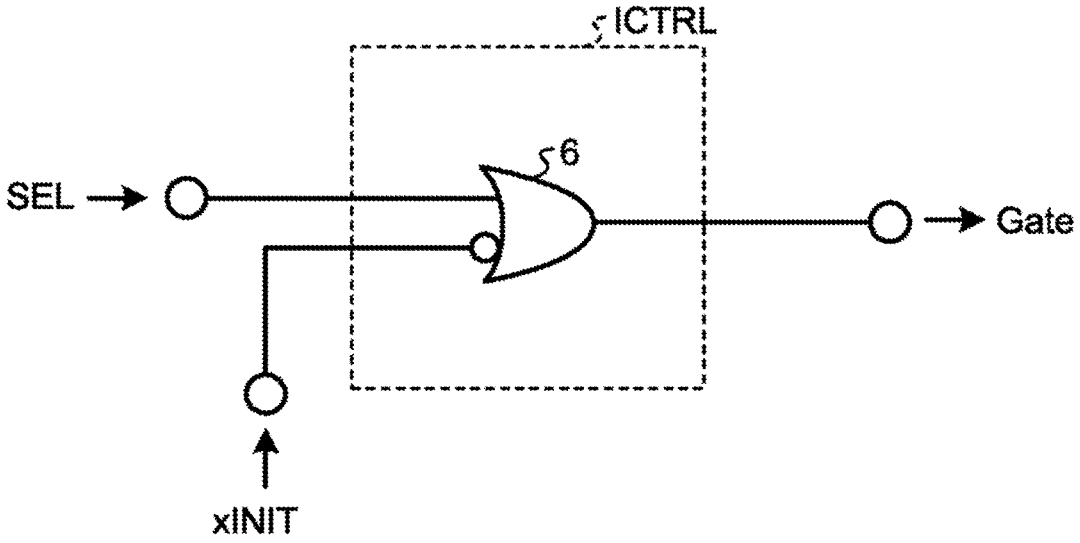
FIG. 5 is a diagram illustrating a configuration of the initialization control circuit according to the first comparative example.

FIG. 5 is a diagram illustrating a configuration of the initialization control circuit according to the first comparative example.

As illustrated in FIG. 5, the initialization control circuit ICTRL may include an OR circuit 6 that performs an OR operation with the selection signal SEL and the inversion of the initialization signal xINIT.

Figure 6:
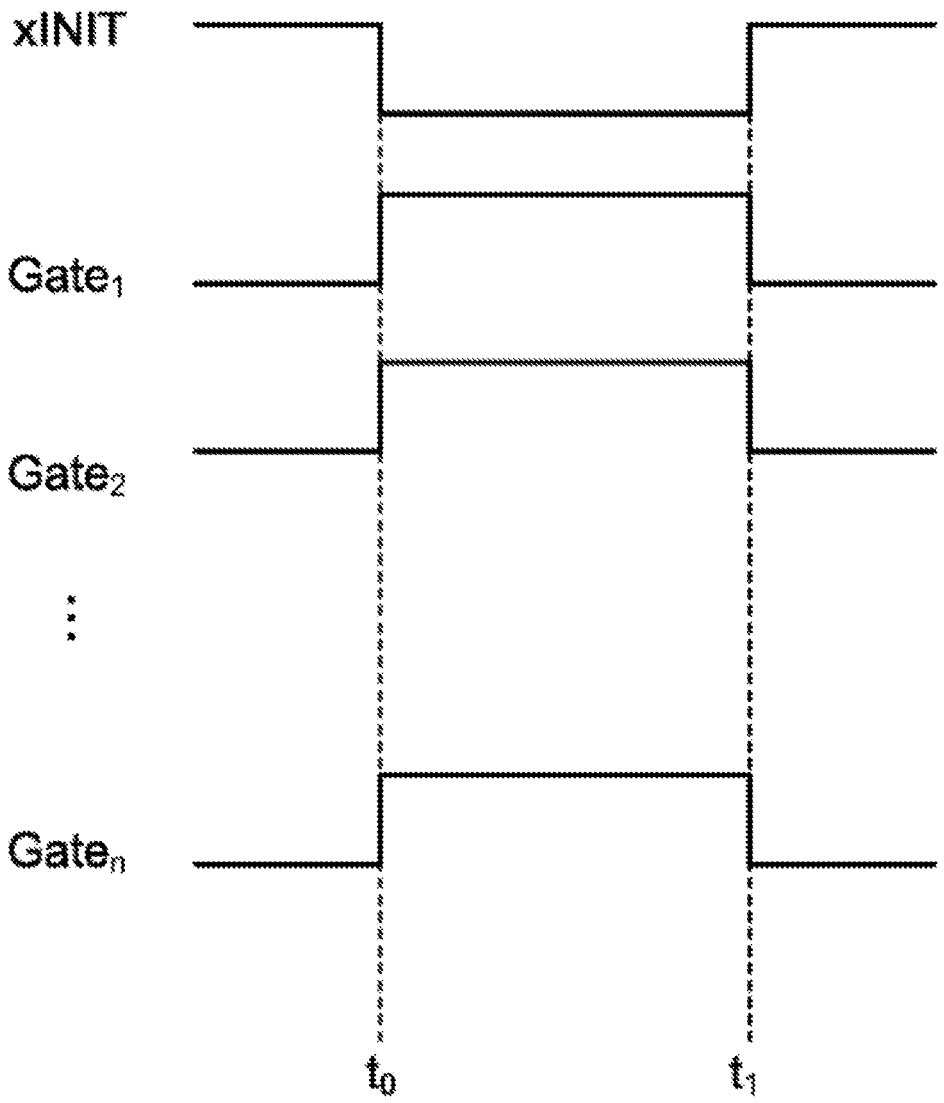
FIG. 6 is a diagram illustrating operation timing of the vertical drive circuit according to the first comparative example.

FIG. 6 is a diagram illustrating operation timing of the vertical drive circuit according to the first comparative example.

As illustrated in FIG. 6, at timing $t_0$, the initialization signal xINIT assumes a low level, and a plurality of gate signals $Gate_1$, $Gate_2$, . . . $Gate_n$ assume high levels simultaneously. When the gate signals $Gate_1$, $Gate_2$, . . . $Gate_n$ simultaneously assume high levels, the output circuit SDa (see FIG. 2) in the horizontal drive circuit SD is coupled to the n pixels PX belonging to a single column simultaneously.

At timing $t_1$, the initialization signal xINIT assumes a high level, and the gate signals $Gate_1$, $Gate_2$, . . . $Gate_n$ assume low levels simultaneously.

Referring to FIG. 2 again, a situation of initializing the node N1 of the memory MEM to have a low level is examined. In this case, the output circuit SDa outputs the source signal SIG of a low level to the image signal line SL. At this time, if the inverter circuit INV2 is outputting a high level signal to the node N1, the drive capability (current drive capability) of the output circuit SDa needs to outperform the drive capability (current drive capability) of the inverter circuit INV2.

Moreover, because the gate signals $Gate_1$, $Gate_2$, . . . $Gate_n$ simultaneously assume high levels, the output circuit SDa is coupled to the n pixels PX included in a single column simultaneously. When considering the worst case in which all of the nodes N1 of the n pixels PX included in a single column are at a high level, the drive capability of the output circuit SDa needs to outperform a sum of the drive capabilities of the n inverter circuits INV2.

When the drive capability of the output circuit SDa does not outperform the sum of the drive capabilities of the n inverter circuits INV2, a phenomenon of being unable to initialize some of the n pixels PX in a single column occurred in an actual experiment.

As a means of resolving this phenomenon, it is conceivable to suppress, by inserting a resistor in series with a power supply line that supplies electric power to the inverter circuit INV2, the drive capability of the inverter circuit INV2. However, as a result of having produced display apparatuses employing this means experimentally, some display apparatuses malfunctioned although improvement was seen.

As another means of resolving the above-described phenomenon, it is conceivable to increase the drive capability of the output circuit SDa. However, due to high resolution of display apparatuses in recent years, the number of pixels PX in a display apparatus has been increased and the number of pixels PX in a single column has been increased. For example, when a display apparatus has 1920 rows by 1080 columns of pixels PX, a single column includes 1080 pixels PX.

Accordingly, with the increase in the number of pixels PX in a single column, the drive capability of the output circuit SDa needs to be increased. In order to increase the drive capability of the output circuit SDa, the size of the output circuit SDa needs to be increased. This does not meet the demands for downsizing and power-saving of the display apparatus, and is undesirable.

In the active-matrix display apparatus, only a single column is selected at one timing in normal image display. Thus, when considering only the normal image display, the drive capability of the output circuit SDa is sufficient if it outperforms the drive capability of a single inverter circuit INV2. However, when considering the initialization also, the drive capability of the output circuit SDa needs to outperform the drive capability of the 1080 inverter circuits INV2, for example. This is over-engineered for the normal image display, does not meet the demands for downsizing and power-saving of the display apparatus, and is undesirable.

Second Comparative Example

Figure 7:
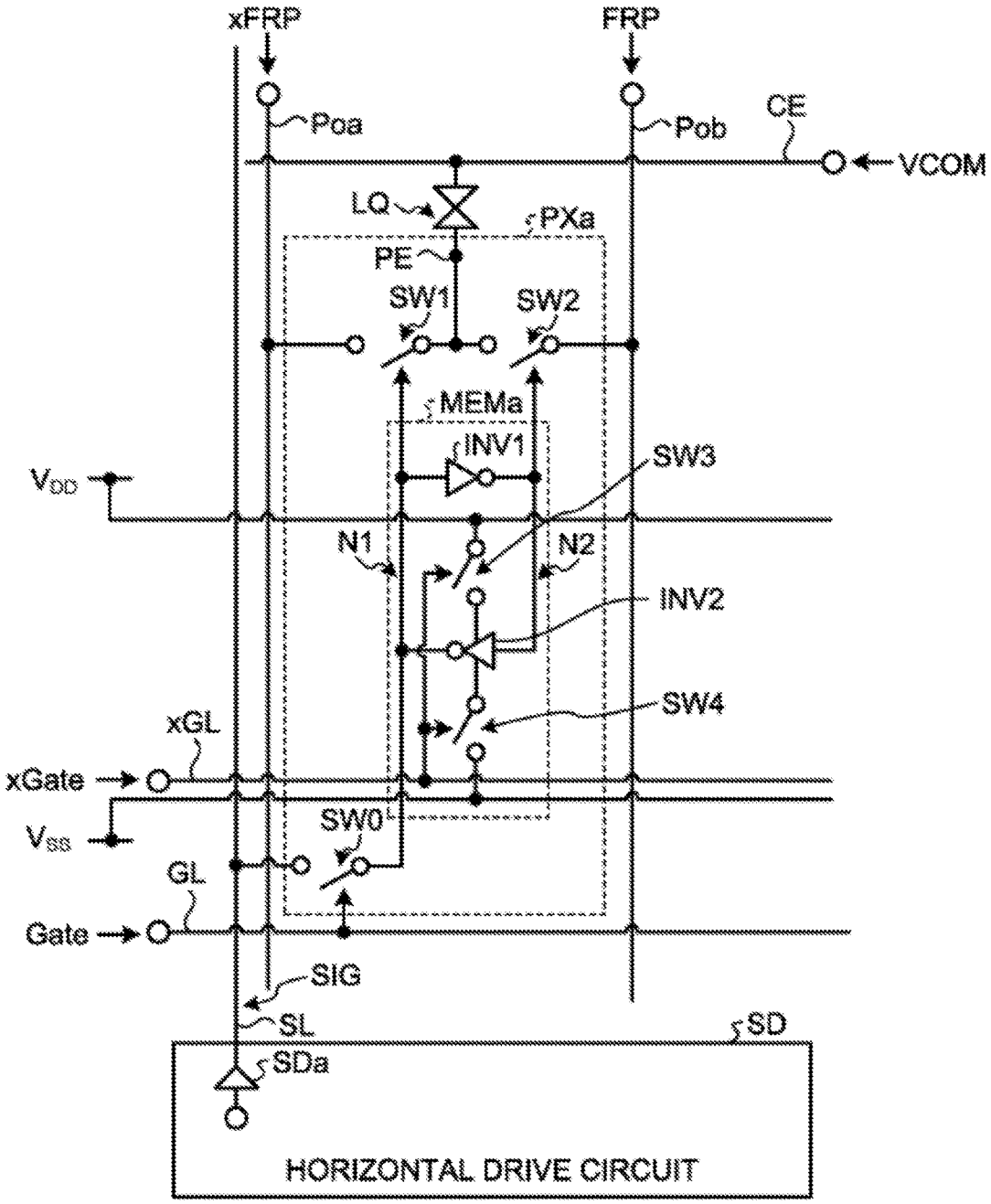
FIG. 7 is a diagram illustrating a configuration of a pixel according to a second comparative example.

FIG. 7 is a diagram illustrating a configuration of a pixel according to a second comparative example.

A pixel PXa includes a memory MEMa. The memory MEMa further includes, in addition to the components of the memory MEM (see FIG. 2) in the embodiment, a switch SW3 and a switch SW4.

Control terminals of the switch SW3 and the switch SW4 are coupled to an inverted-gate signal line xGL, and are supplied with an inverted gate signal xGate. The inverted gate signal xGate is a logical inversion signal of the gate signal Gate. When the inverted gate signal xGate is at a high level, the switch SW3 assumes an on-state, and a power source potential $V_{DD}$ that is a high potential is supplied to the inverter circuit INV2. When the inverted gate signal xGate is at a high level, the switch SW4 assumes an on-state, and a power source potential $V_{SS}$ that is a low potential is supplied to the inverter circuit INV2.

Accordingly, when the gate signal Gate is at a high level, the inverted gate signal xGate is at a low level, such that the electric power is not supplied to the inverter circuit INV2 and the inverter circuit INV2 outputs no signal. Thus, if the output circuit SDa has the drive capability that is required in normal image display, the output circuit SDa can initialize the n pixels PXa in a single column.

The pixel PXa in the second comparative example further includes the switch SW3 and the switch SW4, as compared with the pixel PX in the embodiment. Accordingly, the pixel PXa in the second comparative example has more elements than that of the pixel PX in the embodiment. Consequently, the pixel PXa has a circuit area larger than that of the pixel PX.

As with the pixel PX in the embodiment, the inverted-gate signal line xGL may not be provided for the pixel PXa. In such a case, wiring corresponding to the inverted-gate signal line xGL needs to be provided for the pixel PXa only for the initialization. Consequently, the pixel PXa has a circuit area larger than that of the pixel PX.

Thus, the configuration of the second comparative example does not meet the demand for high definition of the display apparatus, and is undesirable.

Configuration of Vertical Drive Circuit in Embodiment

Figure 8:
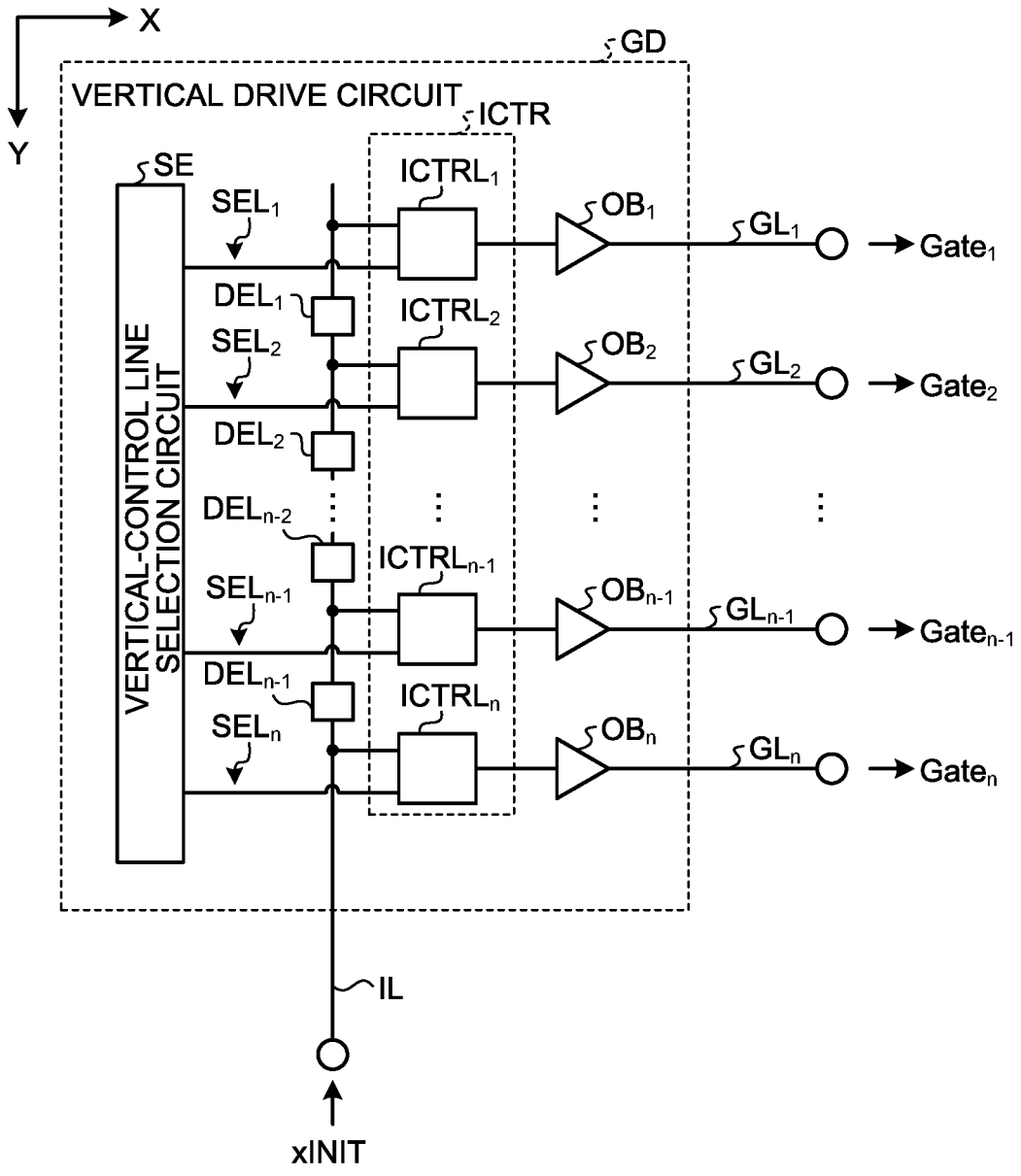
FIG. 8 is a diagram illustrating a configuration of a vertical drive circuit according to the embodiment.

FIG. 8 is a diagram illustrating a configuration of a vertical drive circuit (a vertical driver) according to the embodiment.

The vertical drive circuit GD illustrated in FIG. 8 further includes, in addition to the components of the vertical drive circuit GDa (see FIG. 3) in the comparative example, a plurality of delay circuits $DEL_{n-1}$, $DEL_{n-2}$, . . . $DEL_1$ coupled in series. The delay circuit DEL is a logic circuit that outputs a binary signal. The logic circuit includes a combination circuit or a sequential circuit.

The delay circuit $DEL_{n-1}$ at the most upstream stage receives the initialization signal xINIT. The logic circuit has a delay time of several nanoseconds to several tens of nanoseconds. The output signal from the delay circuit $DEL_{n-1}$ is a signal for which the initialization signal xINIT has been delayed, and is supplied to an initialization control circuit (an initializer) $ICTRL_{n-1}$ and the delay circuit $DEL_{n-2}$. Subsequently, in the same manner, the output signal from the delay circuit $DEL_i$ (i is an integer of n−1 to 2) is supplied to the initialization control circuit $ICTRL_i$ and the delay circuit $DEL_{i-1}$. The delay circuit $DEL_1$ at the most downstream stage is supplied with the output signal from the delay circuit $DEL_2$. The output signal from the delay circuit $DEL_1$ is supplied to the initialization control circuit $ICTRL_1$. That is, the delay circuits DEL sequentially delay the initialization signal xINIT.

In the embodiment, it has been described that the delay circuit $DEL_{n-1}$ is a circuit at the most upstream stage and the delay circuit $DEL_1$ is a circuit at the most downstream stage. However, the embodiment is not limited thereto. The delay circuit $DEL_1$ may be a circuit at the most upstream stage, the delay circuit $DEL_{n-1}$ may be a circuit at the most downstream stage, and the initialization signal xINIT may be input to the delay circuit $DEL_1$ at the most upstream stage.

The initialization signal xINIT is an example of "a control signal" of the present invention. The initialization control circuits ICTRL are an example of "a plurality of control circuits" of the present invention.

Figure 9:
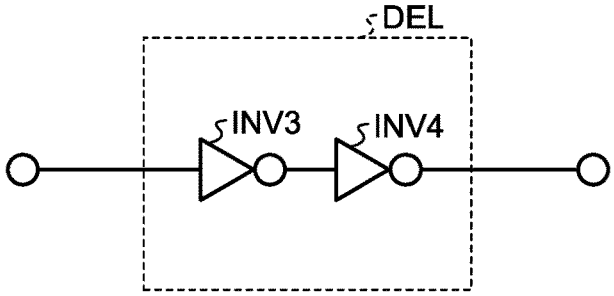
FIG. 9 is a diagram illustrating a configuration example of a delay circuit according to the embodiment.

FIG. 9 is a diagram illustrating a configuration example of the delay circuit according to the embodiment.

The delay circuit DEL of the embodiment is a buffer circuit having two inverter circuits INV3 and INV4 that are coupled in series. The delay circuit DEL illustrated in FIG. 9 is for the purposes of illustration and is not limited thereto. For example, the delay circuit DEL may be configured such that inverter circuits of an even number are coupled in series. The delay time can be adjusted by changing the number of inverter circuits of the delay circuit DEL.

In the embodiment, the initialization control circuits ICTRL and the delay circuits DEL are arranged along the Y direction. However, the embodiment is not limited thereto.

For example, when the pixels PX are arranged in a circular pattern, the initialization control circuits ICTRL and the delay circuits DEL may be arranged in a circular arc pattern along the outer circumference of the pixels PX.

In the embodiment, the delay circuits DEL may be arranged in the Y direction and at positions between the corresponding initialization control circuits ICTRL. The delay circuits DEL may be arranged in the Y direction and at positions between the corresponding lines that are extended portions of the gate signal lines GL. The delay circuits DEL may be arranged at equal intervals.

In the embodiment, it has been described that the delay circuits DEL are arranged in the frame area. However, the embodiment is not limited thereto. For example, when the display apparatus 1 is a reflective liquid crystal display apparatus or a transflective liquid crystal display apparatus, a part of or all of the delay circuits DEL may be arranged on a layer lower than a reflecting layer of the display area DA.

Figure 10:
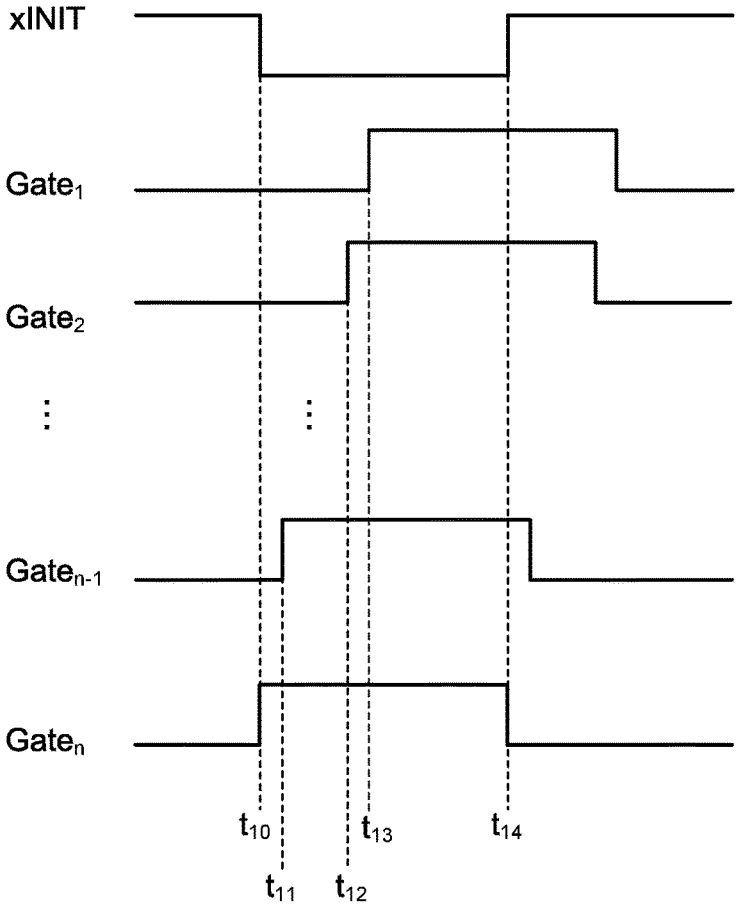
FIG. 10 is a diagram illustrating operation timing of the vertical drive circuit according to the embodiment.

FIG. 10 is a diagram illustrating operation timing of the vertical drive circuit according to the embodiment.

As illustrated in FIG. 10, at timing $t_{10}$, the initialization signal xINIT assumes a low level, and the gate signal $Gate_n$ assumes a high level.

At timing $t_{11}$, the output signal from the delay circuit $DEL_{n-1}$ assumes a low level, and the gate signal $Gate_{n-1}$ assumes a high level. The timing $t_{11}$ is a timing at which the delay time of the delay circuit $DEL_{n-1}$ has elapsed from the timing $t_{10}$.

In the same manner, at timing $t_{12}$, the output signal from the delay circuit $DEL_2$ assumes a low level, and the gate signal $Gate_2$ assumes a high level.

At timing $t_{13}$, the output signal from the delay circuit $DEL_1$ assumes a low level, and the gate signal $Gate_1$ assumes a high level. The timing $t_{13}$ is a timing at which the delay time of the delay circuit $DEL_1$ has elapsed from the timing $t_{12}$.

At timing $t_{14}$, the initialization signal xINIT assumes a high level, and then the gate signals $Gate_{n-1}$, $Gate_{n-2}$, . . . $Gate_1$ assume low levels in sequence.

In the vertical drive circuit GD, even when the initialization signal xINIT becomes active, only one gate signal Gate changes at one timing. For example, at the timing $t_{10}$, only the gate signal $Gate_n$ changes, and the gate signals $Gate_1$ to $Gate_{n-1}$ do not change. Accordingly, the output circuit SDa only needs to be configured to invert the output of the inverter circuit INV2 in a single pixel PX, to which the gate signal $Gate_n$ is supplied, at the timing $t_{10}$.

For example, at the timing $t_{11}$, only the gate signal $Gate_{n-1}$ changes, and the gate signals $Gate_1$ to $Gate_{n-2}$ and the gate signal $Gate_n$ do not change. The output of the inverter circuit INV2 in the single pixel PX, to which the gate signal $Gate_n$ is supplied, has already been inverted at the timing $t_{10}$. Thus, the output circuit SDa only needs to invert the output of the inverter circuit INV2 in a single pixel PX, to which the gate signal $Gate_{n-1}$ is supplied, at the timing $t_{11}$.

That is, the output circuit SDa only needs to invert the output of a single inverter circuit INV2 in initialization. Thus, even when considering both of the normal image display and the initialization, the drive capability of the output circuit SDa is sufficient if it outperforms the drive capability of a single inverter circuit INV2. Consequently, the output circuit SDa can stably initialize the n pixels PX belonging to a single column. That is, the display apparatus 1 can stably initialize all of the pixels PX.

Accordingly, in the display apparatus 1, there is no need to increase the drive capability of the output circuit SDa, as compared to the first comparative example, and there is no need to increase the size of the output circuit SDa. Consequently, the display apparatus 1 can meet the requests of downsizing and power-saving.

Furthermore, the memory MEM does not need to include the switch SW3 and the switch SW4, as compared to the memory MEMa of the second comparative example. The inverted-gate signal line xGL does not need to be provided for the memory MEM only for the initialization, as compared to the memory MEMa of the second comparative example. Consequently, the display apparatus 1 can meet the request of high definition.

Assuming that the delay time of the delay circuit DEL is 50 nanoseconds, and n=1080, the time from the timing $t_{10}$ up to the timing $t_{13}$ is 50 (nanoseconds)×1080=54 (microseconds). That is, the display apparatus 1 can initialize all of the pixels PX in 54 microseconds. Thus, the display apparatus 1 can initialize all of the pixels PX in a short time, as compared with 16.67 milliseconds that is required to write a low level or a high level value into the pixels PX row by row in synchronization with the clock signal in the same manner as ordinary image display.

First Modification

The delay circuit DEL may include an analog circuit.

Figure 11:
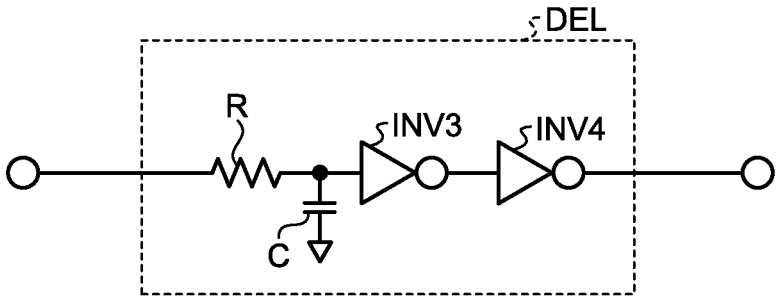
FIG. 11 is a diagram illustrating a configuration example of a delay circuit according to a first modification.

FIG. 11 is a diagram illustrating a configuration example of a delay circuit according to a first modification. The delay circuit DEL illustrated in FIG. 11 includes an RC circuit having a resistor R and a capacitor C on the input side of the two inverter circuits INV3 and INV4 that are coupled in series. In the delay circuit DEL illustrated in FIG. 11, the delay time can be adjusted by changing the resistance value of the resistor R or the capacitance of the capacitor C.

Second Modification

Figure 12:
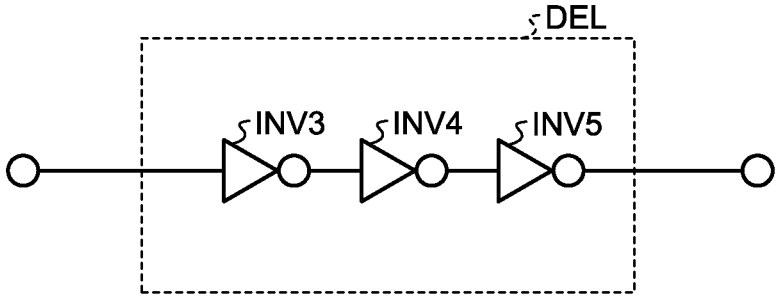
FIG. 12 is a diagram illustrating a configuration example of a delay circuit according to a second modification.

FIG. 12 is a diagram illustrating a configuration example of a delay circuit according to a second modification. The delay circuit DEL illustrated in FIG. 12 includes three inverter circuits INV3, INV4, and INV5 that are coupled in series. The delay circuit DEL illustrated in FIG. 12 is for the purpose of illustration and is not limited thereto. For example, the delay circuit DEL may be configured such that inverter circuits of an odd number are coupled in series. The delay time of the delay circuit DEL can be adjusted by changing the number of inverter circuits.

When the delay circuit DEL illustrated in FIG. 12 is applied to the vertical drive circuit GD illustrated in FIG. 8, the logic of the output signal from the delay circuit DEL is inverted row by row. Accordingly, leaving the initialization control circuits $ICTRL_k$ (k=n, n−2, . . . ) as they are, the logic of the initialization control circuits $ICTRL_1$ (1=n−1, n−3, . . . ) needs to be inverted.

Figures 13, 14:
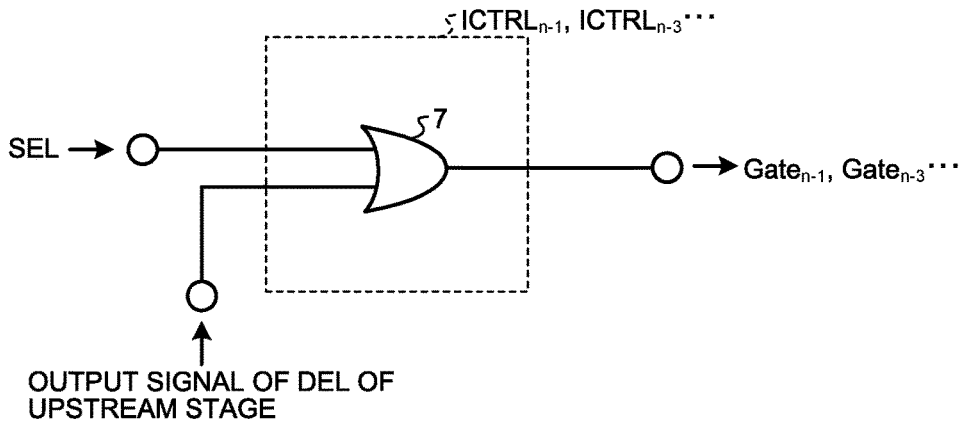
FIG. 13 is a diagram illustrating a truth table of an initialization control circuit according to the second modification.
FIG. 14 is a diagram illustrating a configuration of the initialization control circuit according to the second modification.

FIG. 13 is a diagram illustrating a truth table of the initialization control circuit according to the second modification.

The first input signal supplied to the first input terminal of the initialization control circuit $ICTRL_1$ (1=n−1, n−3, . . . ) is the output signal (a logic inverted signal of the initialization signal xINIT) from the delay circuit DEL provided on the input side of the initialization control circuit $ICTRL_1$. The first input signal has a positive logic (high-active). The second input signal (the selection signal SEL) supplied to the second input terminal of the initialization control circuit ICTRL has a positive logic (high-active). The output signal (the gate signal Gate) from the initialization control circuit ICTRL has a positive logic (high-active).

When the output signal (the logic inverted signal of the initialization signal xINIT) from the delay circuit DEL provided on the input side of the initialization control circuit $ICTRL_1$ (1=n−1, n−3, . . . ) is active, that is, when the output signal (the logic inverted signal of the initialization signal xINIT) from the delay circuit DEL is at a high level, the initialization control circuit $ICTRL_1$ causes the gate signal Gate to be active. That is, the initialization control circuit $ICTRL_1$ outputs the gate signal Gate of a high level regardless of the value of the selection signal SEL, as indicated in the third row and the fourth row of the truth table T2.

When the output signal (the logic inverted signal of the initialization signal xINIT) from the delay circuit DEL provided on the input side of the initialization control circuit ICTRL is non-active, that is, when the output signal (the logic inverted signal of the initialization signal xINIT) from the delay circuit DEL is at a low level, the initialization control circuit ICTRL causes the gate signal Gate to be active or non-active depending on the value of the selection signal SEL. That is, when the output signal (the logic inverted signal of the initialization signal xINIT) from the delay circuit DEL provided on the input side of the initialization control circuit ICTRL is at a low level and the selection signal SEL is at a low level, the initialization control circuit ICTRL causes the gate signal Gate to be non-active. That is, the initialization control circuit ICTRL outputs the gate signal Gate of a low level, as indicated in the first row of the truth table T2.

When the output signal (the logic inverted signal of the initialization signal xINIT) from the delay circuit DEL provided on the input side of the initialization control circuit ICTRL is at a low level and the selection signal SEL is at a high level, the initialization control circuit ICTRL causes the gate signal Gate to be active. That is, the initialization control circuit ICTRL outputs the gate signal Gate of a high level, as indicated in the second row of the truth table T2.

FIG. 14 is a diagram illustrating the configuration of the initialization control circuit according to the second modification.

As illustrated in FIG. 14, the initialization control circuit ICTRL can be made up of an OR circuit 7. The OR circuit 7 performs an OR operation on the selection signal SEL and the output signal (the logic inverted signal of the initialization signal xINIT) from the delay circuit DEL provided on the input side of the initialization control circuit ICTRL.

In the foregoing, the preferred embodiment of the present invention has been explained. The invention, however, is not limited to such an embodiment. The content disclosed in the embodiment is merely an example, and various modifications can be made without departing from the scope of the present invention. The appropriate modifications made without departing from the scope of the present invention also belong to the technical scope of the present invention.

What is claimed is:

1. A display apparatus comprising:

a plurality of pixels each of which includes a memory for storing a signal corresponding to image information;

a plurality of image signal lines each of which is configured to supply the signal corresponding to the image information;

a plurality of switches each of which is included in a corresponding one of the pixels and couples a corresponding one of the image signal lines to the memory of the corresponding one of the pixels;

a plurality of gate signal lines, a control input side of each of the switches being coupled to a corresponding one of the gate signal lines;

a plurality of logic circuits that are coupled in series, the logic circuit at a most upstream stage of the logic circuits being configured to receive a control signal, and each of the logic circuits being configured to output an output signal; and a plurality of control circuits each of which is configured to receive the control signal and the output signal and output a gate signal to a corresponding one of the gate signal lines based on the control signal or the output signal.

2. The display apparatus according to claim 1, wherein the control circuits are arranged along one direction, and wherein the logic circuits are arranged along the one direction and at positions between the corresponding control circuits.

3. The display apparatus according to claim 1, further comprising a vertical-control line selection circuit that is configured to output a plurality of selection signals to the control circuits to cause the pixels to perform image display, the selection signals being signals for sequentially selecting the gate signal lines, wherein the logic circuits are arranged between the vertical-control line selection circuit and the control circuits.

4. The display apparatus according to claim 1, wherein the logic circuits are arranged along one direction.

5. The display apparatus according to claim 1, wherein the logic circuits sequentially delay the control signal.

6. The display apparatus according to claim 1, wherein each of the logic circuits is a buffer circuit.

7. The display apparatus according to claim 1, wherein each of the logic circuits includes an inverter circuit.

8. The display apparatus according to claim 1, wherein the control signal is output when an identical signal from the image signal lines is written to the memories included in a single column of the pixels.

9. The display apparatus according to claim 8, wherein each of the image signal lines is configured to supply a signal different from the signal the corresponding memories hold.

10. The display apparatus according to claim 1, wherein the logic circuits are arranged in a frame area outside a display area in which the pixels are arrayed.

11. The display apparatus according to claim 4, wherein the logic circuits have an identical circuit configuration and are arranged at equal intervals along the one direction.

12. The display apparatus according to claim 1, wherein each of the pixels includes a pixel electrode, and wherein the pixel electrode is configured to be supplied with a first display voltage or a second display voltage, based on the signal stored in the memory.

13. The display apparatus according to claim 12, wherein the display apparatus is a reflective liquid crystal display apparatus.

* * * * *